US012044415B2

(12) United States Patent
Stephens et al.

(10) Patent No.: US 12,044,415 B2
(45) Date of Patent: Jul. 23, 2024

(54) CONVECTION OVEN

(71) Applicant: ILLINOIS TOOL WORKS INC., Glenview, IL (US)

(72) Inventors: Jason M. Stephens, Bonney Lake, WA (US); Robert Keehan, Graham, WA (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 457 days.

(21) Appl. No.: 17/375,698

(22) Filed: Jul. 14, 2021

(65) Prior Publication Data

US 2022/0034517 A1 Feb. 3, 2022

Related U.S. Application Data

(60) Provisional application No. 63/059,246, filed on Jul. 31, 2020.

(51) Int. Cl.
*F24C 15/32* (2006.01)
*F24C 7/08* (2006.01)

(52) U.S. Cl.
CPC ..... *F24C 7/087* (2013.01); *F24C 7/085* (2013.01); *F24C 15/325* (2013.01)

(58) Field of Classification Search
CPC ..... F24C 7/087; F24C 7/085; F24C 15/325
USPC ..... 126/21 A
See application file for complete search history.

(56) References Cited

U.S. PATENT DOCUMENTS

| | | | | |
|---|---|---|---|---|
| 5,253,564 | A * | 10/1993 | Rosenbrock | A21B 1/48 99/335 |
| 5,394,791 | A | 3/1995 | Vallee | |
| 5,562,022 | A | 10/1996 | Schmid | |
| 5,617,839 | A | 4/1997 | Jennings | |
| 5,653,164 | A | 8/1997 | Vellee | |
| 5,813,711 | A | 9/1998 | Sauvagnat | |
| 6,642,486 | B1 | 11/2003 | Anderson | |
| 6,837,234 | B2 | 1/2005 | Rabas | |
| 6,854,457 | B2 | 2/2005 | Rabas | |
| 6,883,513 | B2 | 4/2005 | Bock | |
| 7,094,995 | B2 | 8/2006 | Mills | |
| 7,297,904 | B2 | 11/2007 | Paller | |
| 7,301,130 | B2 | 11/2007 | Mills | |
| 7,353,821 | B2 | 4/2008 | Saksena | |
| 7,527,051 | B2 | 5/2009 | Schmitz | |
| 7,547,864 | B2 | 6/2009 | Beausse | |
| 7,634,992 | B2 | 12/2009 | Bujeau | |

(Continued)

*Primary Examiner* — Avinash A Savani
(74) *Attorney, Agent, or Firm* — THOMPSON HINE LLP

(57) ABSTRACT

An oven includes a cooking chamber for receiving food product to be cooked, a door movable between an open condition and a closed condition relative to the cooking cavity, a heating system for generating heat and a fan system for moving heated air through the cooking cavity. A controller is configured for controlling the heating system and the fan system. The controller includes an associated memory storing a first set of operating parameter values and a second set of operating parameter values. The controller is configured to identify whether the oven is in the cook state or the idle state. The controller uses the first set of operating parameter values to control the heating system and the fan system during the cook state, and uses the second set of operating parameter values to control the heating system and the fan system during the idle state.

10 Claims, 4 Drawing Sheets

(56) References Cited

U.S. PATENT DOCUMENTS

| | | | | |
|---|---|---|---|---|
| 7,875,834 | B2 | 1/2011 | Bujeau | |
| 8,080,766 | B2 | 12/2011 | Frock | |
| 8,138,459 | B2 | 3/2012 | Beausse | |
| 8,151,697 | B2 | 4/2012 | Valentine | |
| 8,191,465 | B2 | 6/2012 | Sager | |
| 8,201,552 | B2 | 6/2012 | Ploof | |
| 8,281,779 | B2 * | 10/2012 | Wiker | A21B 1/40 99/360 |
| 8,555,776 | B2 | 10/2013 | Murphy | |
| 8,813,740 | B2 | 8/2014 | Linton | |
| 9,204,661 | B2 | 12/2015 | Ploof | |
| 9,372,000 | B2 | 6/2016 | Ploof | |
| 9,618,211 | B2 | 4/2017 | Stone | |
| 9,809,909 | B2 | 11/2017 | Melgaard | |
| 10,057,946 | B2 | 8/2018 | Mills | |
| 10,208,964 | B2 | 2/2019 | Cupp | |
| 10,251,223 | B2 | 4/2019 | Linton | |
| 10,627,119 | B2 | 4/2020 | Carcano | |
| 10,728,962 | B2 | 7/2020 | Rollet | |
| 10,757,766 | B2 | 8/2020 | Rollet | |
| 10,767,283 | B2 | 9/2020 | Melgaard | |
| 11,026,535 | B2 | 6/2021 | Grimaldi | |
| 2008/0087173 | A1 * | 4/2008 | Milz | A21B 1/245 426/243 |

* cited by examiner

CONVECTION OVEN

TECHNICAL FIELD

This application relates generally to commercial cooking ovens and, more specifically, to rack ovens and other convection ovens.

BACKGROUND

In commercial kitchens (e.g., found in restaurant, cafeteria and retail environments) rack ovens are used for baking and/or cooking (generically referred to as cooking or cook herein) a variety of food items. Such ovens may utilize heaters in the form of gas-burners for generating heat (e.g., multiple burners that fire into respective heat exchange tubes), in combination with one or more fans to move heated air within the oven (e.g., air moves across the heat-exchange tubes and through the cooking chamber over the food product). However, rack ovens utilizing electric heating elements (e.g., resistive heaters) are also known. The food product is typically supported on an upright rack within the cooking chamber. In some cases, the rack can be moved in and out of the cooking chamber (e.g., the rack includes rollers to enable wheeling the rack in and out of the chamber). The rack may be rotated within the chamber during cooking.

In such rack ovens, the chamber is often maintained heated in a ready to cook state even when food product is not in the chamber. The cook state of the oven is defined as when the oven is operated to prepare food items, cooking a product, and the cook timer is actively counting down. The idle state of the oven is defined as when the oven is not actively cooking a product, the timer is not actively counting down, but the oven is still maintaining the internal temperature requested by the operator.

Most existing rack ovens are set up with parameters to operate with high precision during the cook state. This setup is beneficial for the quality of the product cooked during the cook state. However, these same parameters apply during the idle state, which negatively effects the energy efficiency of the oven, and the life of the equipment.

Accordingly, it would be desirable to provide a rack oven configured to operate in a more effective manner that increases overall efficiency and/or oven life.

SUMMARY

In one aspect, an oven includes a cooking chamber for receiving food product to be cooked, a door movable between an open condition and a closed condition relative to the cooking cavity, a heating system for generating heat and a fan system for moving heated air through the cooking cavity. A controller is configured for controlling the heating system and the fan system, wherein the controller includes an associated memory storing a first set of operating parameter values and a second set of operating parameter values. A cook state of the oven is an operating state in which food product is to be cooked in the cooking chamber and an idle state of the oven is an operating state in which food product is not being cooked but temperature in the cooking chamber is maintained so as to be ready to carry out a cook state. The controller is configured to identify whether the oven is in the cook state or the idle state. The controller is configured to use the first set of operating parameter values to control the heating system and the fan system during the cook state, and the controller is configured to use the second set of operating parameter values to control the heating system and the fan system during the idle state.

In one implementation of the above aspect, the controller includes a memory storing the first set of operating parameter values and the second set of operating parameter values.

In one implementation of the above aspect, the first set of operating parameter values include: a first upper temperature hysteresis parameter value used to trigger turning off the heating system, a first fan on time parameter value used to control an on duration of the fan system, a first lower temperature hysteresis parameter value used to trigger turning on the heating system and a first fan off time parameter value used to control an off duration of the fan system, and the second set of operating parameter values include: a second upper temperature hysteresis parameter value used to trigger turning off the heating system, a second fan on time parameter value used to control an on duration of the fan system, a second lower temperature hysteresis parameter value used to trigger turning on the heating system and a second fan off time parameter value used to control an off duration of the fan system.

In one implementation, the controller includes and associated user interface, wherein the controller is configured to enable at least the second set of operating parameter values to be modified through use of the user interface.

In another aspect, a convection oven includes a cooking chamber for receiving food product to be cooked, a door movable between an open condition and a closed condition relative to the cooking cavity, a heating system for generating heat, a fan system for moving heated air through the cooking cavity and a controller configured for controlling the heating system according to a first heat control parameter and for controlling the fan system according to a first fan control parameter. A cook state of the oven is an operating state in which food product is to be cooked in the cooking chamber and an idle state of the oven is an operating state in which food product is not being cooked but temperature in the cooking chamber is maintained so as to be ready to carry out a cook state. The controller is configured such that, during the cook state, a first cook value or setting is used by the controller for the first heat control parameter and a first fan value or setting is used by the controller for the first fan control parameter. The controller is configured such that, during the idle state, a second cook value or setting is used by the controller for the first heat control parameter and a second fan value or setting is used by the controller for the first fan control parameter. The second cook value or setting is different than the first cook value or setting and the second fan value or setting is different than the first fan value or setting.

In one implementation of the immediately preceding aspect, the controller includes a memory that stores each of the first cook value or setting, the second cook value or setting, the first fan value or setting and the second fan value or setting.

In such implementation, the oven may further include a cook timer, wherein the cook state occurs during operation of the cook timer, and the idle stat occurs when the cook timer is not operating.

In one example of such implementation, the first heat control parameter is a first temperature hysteresis parameter, wherein the first fan control parameter is a first fan run time parameter.

In one variation of such example, the controller is configured for controlling the heating unit according to a second heat control parameter and for controlling the fan system according to at least a second fan control parameter; the first temperature hysteresis parameter is an upper temperature hysteresis parameter used to trigger turning off the heating system, wherein the first fan run time parameter is a fan on time parameter used to control an on duration of the fan system; and the second heat control parameter is a lower temperature hysteresis parameter used to trigger turning on the heating system, wherein the second fan control parameter is a fan off timer parameter used to control an off duration of the fan system.

In one implementation of the immediately preceding aspect, the controller includes an associated user interface and a memory, the first cook value or setting, the second cook value or setting, the first fan value or setting and the second fan value or setting are stored in the memory, and the controller is configured to enable at least the second cook value or setting and the second fan value or setting to be modified through use of the user interface. The controller may also be configured to enable the first cook value or setting to be modified through use of the user interface.

In a further aspect, a method of operating an oven that includes both a heating system and a fan system involves: operating the oven in a cook state during which the heating system is controlled based at least in part upon a setpoint temperature, wherein during the cook state a first hysteresis temperature range encompassing the setpoint temperature is used to control an on or off state of the heating system; and operating the oven in an idle state during which the heating system is controlled based at least in part upon a setpoint temperature, wherein during the idle state a second hysteresis temperature range encompassing the setpoint temperature is used to control an on or off state of the heating system, wherein the second hysteresis temperature range is different than the first hysteresis temperature range.

In yet another aspect, a method of operating an oven that includes both a heating system and a fan system involves: operating the heating system and the fan system in a cook state of the oven, wherein during the cook state a first set of operating parameter values are used to control the heating system and the fan system; and operating the heating system and the fan system in an idle state of the oven, wherein during the idle state a second set of operating parameter values are used to control the heating system and the fan system. In one implementation of this method, the first set of operating parameter values include: a first upper temperature hysteresis parameter value used to trigger turning off the heating system, a first fan on time parameter value used to control an on duration of the fan system, a first lower temperature hysteresis parameter value used to trigger turning on the heating system and a first fan off time parameter value used to control an off duration of the fan system, and the second set of operating parameter values include: a second upper temperature hysteresis parameter value used to trigger turning off the heating system, a second fan on time parameter value used to control an on duration of the fan system, a second lower temperature hysteresis parameter value used to trigger turning on the heating system and a second fan off time parameter value used to control an off duration of the fan system.

The details of one or more embodiments are set forth in the accompanying drawings and the description below. Other features, objects, and advantages will be apparent from the description and drawings, and from the claims.

DETAILED DESCRIPTION

U.S. Pat. Nos. 9,372,000 and 9,204,661, incorporated herein by reference, describe exemplary rack oven configurations. Such ovens generally include a cooking chamber and a heat exchange chamber alongside the cooking chamber. A heating system includes a heat exchanger with a plurality of heat exchange tubes having inlet ends and outlet ends. Each inlet end may each have a respective gas-fired burner aligned therewith and each outlet end may be connected to a common stack. A wall between the cooking chamber and heat exchange chamber includes one or more passages that enable recirculation of air from the cooking chamber, past the heat exchanger and then back to the cooking chamber. A fan system in the nature of a blower or blowers provides recirculating flow across the heat exchanger and through the cooking chamber.

Figure 1:
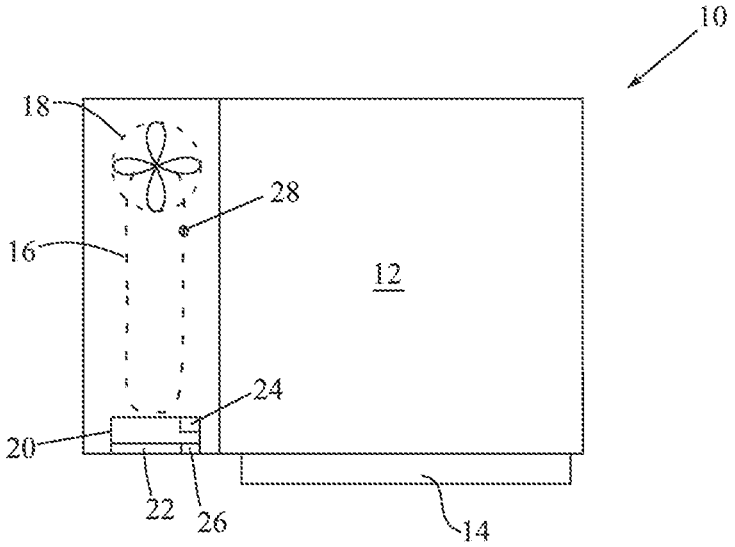
FIG. 1 is a schematic top plan view of an exemplary rack oven.

FIG. 1 shows a schematic depiction of an exemplary rack oven 10, with a cooking chamber 12 accessible by a door 14, a heating system 16 (e.g., employing gas heat exchange tubes and burners) located alongside the cooking chamber, and a fan system 18 for moving the heated air across the heating system and through the cooking chamber 12. An oven controller 20 includes an associated user interface 22 and a memory 24. The controller 20 is configured for controlling the heating system and the fan system as necessary.

As previously indicated, a cook state of the rack oven is an operating state in which food product is to be cooked in the cooking chamber and an idle state of the rack oven is an operating state in which food product is not being cooked but temperature in the cooking chamber is maintained so as to be ready to carry out a cook state. Here, the controller is configured to identify whether the cook state or the idle state is being carried out based upon the status of a cook timer 26 associated with the controller. Generally, for the cook state, the cook timer is set and running according to operator activation when the operator places food product in the chamber for cooking (e.g., baking rolls for 30 minutes).

The controller 20 is also configured to use a first set of operating parameter values to control the heating system and the fan system during the cook state, and to use a second set of operating parameter values to control the heating system and the fan system during the idle state. These values are stored in the memory 24.

By way of example, in one implementation, the operating parameter values include cook values or settings that are hysteresis temperature parameter values for controlling when to turn the heating system on and off and fan values or settings that are fan run time parameter values used for controlling when to turn the fan system on and off. The hysteresis temperature values include an upper temperature hysteresis parameter value used to trigger turning off the heating system (e.g., when the measured temperature, indicated by a temperature sensor 28, is 0° above the temperature set point, or 2° above the temperature set point, etc.) and a lower temperature hysteresis parameter value used to trigger turning on the heating system (e.g., when the measured temperature is 1° degree below the temperature set point, or 2° below the temperature set point, or 5° below the temperature set point, etc.). The fan run time parameter values include a fan on time parameter value used to control an on duration of the fan system (e.g., keep fan on for 15 seconds or 30 seconds or 60 seconds etc.) and a fan off time parameter value used to control an off duration of the fan system (keep fan off for 0 seconds, 10 seconds 30 seconds or 60 seconds, etc.).

Generally, the second set of operating parameter values may be set to provide greater efficiency (less energy use) and less cycling during the idle state than during the cook state. By way of example, Tables 1 and below show exemplary different sets of values for the two different states.

TABLE 1

| Oven State | Circulation fan duty cycle (m:ss) | Heat system Hysteresis (° F.) |
|---|---|---|
| Cook | Fan On Duration: 1:00 | Heat Off: set temp +0 |
| | Fan Off Duration: 0:00 | Heat On: set temp −2 |
| Idle | Fan On Duration: 0:15 | Heat Off: set temp +0 |
| | Fan Off Duration: 1:00 | Heat On: set temp −10 |

TABLE 2

| Oven State | Circulation fan duty cycle (m:ss) | Heat system Hysteresis (° F.) |
|---|---|---|
| Cook | Fan On Duration: 1:00 | Heat Off: set temp +1 |
| | Fan Off Duration: 0:00 | Heat On: set temp −1 |
| Idle | Fan On Duration: 0:10 | Heat Off: set temp +0 |
| | Fan Off Duration: 0:45 | Heat On: set temp −8 |

In the example of Table 1, the fan on and fan off parameter values are set so that the circulation fan operates continuously during the cook state, but during the idle state, the circulation fan is on for 15 seconds, then is off for 1 minute. Similarly, the temperature hysteresis parameter values (Heat Off and Heat On) are set such that the heating system is controlled very precisely within a 2-degree window during the cook state, but in the idle state the heating system is operated less precisely within a 10-degree window. In the example of Table 2, the fan on and fan off parameter values are set so that the circulation fan operates continuously during the cook state, but during the idle state, the circulation fan is on for 10 seconds, then is off for 45 seconds. Similarly, the temperature hysteresis parameter values are set such that the heating system is controlled very precisely within a 2-degree window during the cook state, but in the idle state the heating system is operated less precisely within a 8-degree window. In both examples, use of the different parameter values based on the oven operational state (Cook vs Idle), increases energy efficiency, and reduces wear on the oven systems, based upon the Idle state settings. Fine tuning these parameter values for the operator in both Cook state as well as Idle state can lead to reduced total cost of ownership for the end user. Thus, enabling adjustment of the Idle state parameter values and, in some cases, the Cook state parameter values is desirable.

Figure 2A:
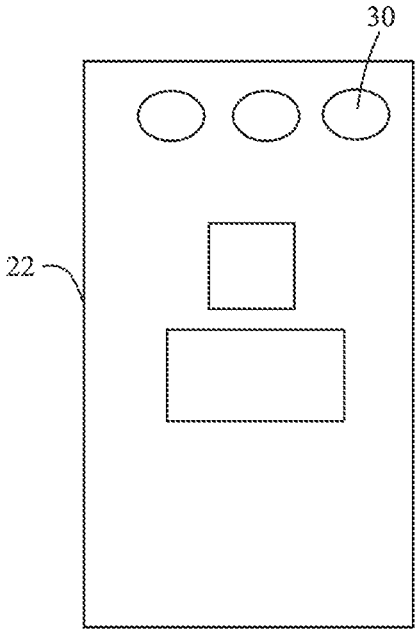
FIGS. 2A-2I show a sequence of user interface interaction screens used to adjust parameter values or settings of the rack oven.
Figure 2B:
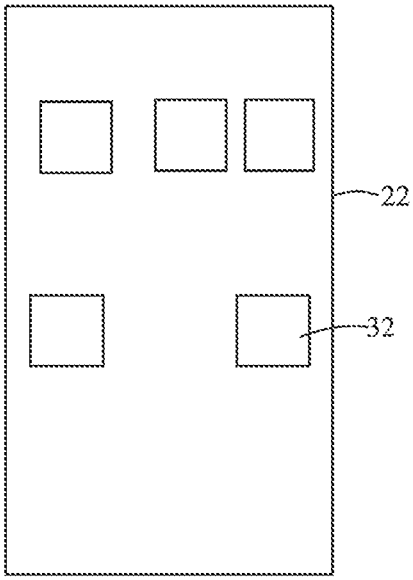
Figure 2C:
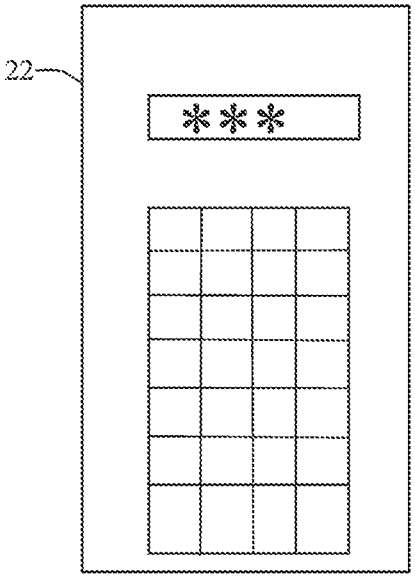
Figure 2D:
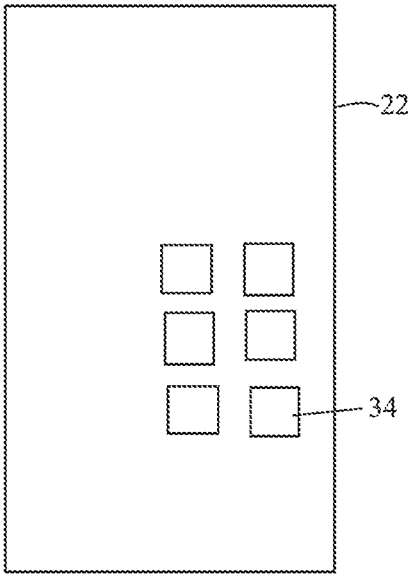
Figure 2E:
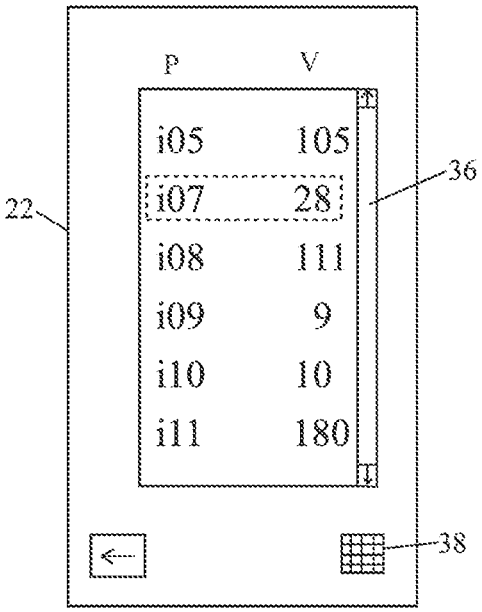
Figure 2F:
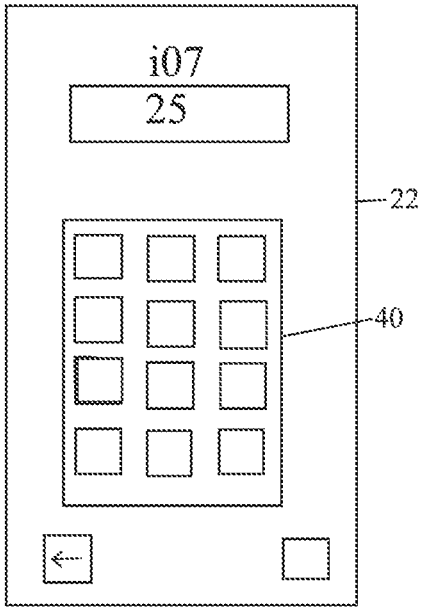
Figure 2G:
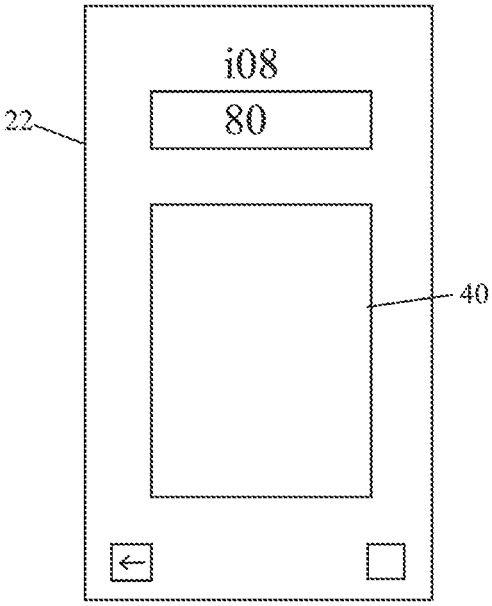
Figure 2H:
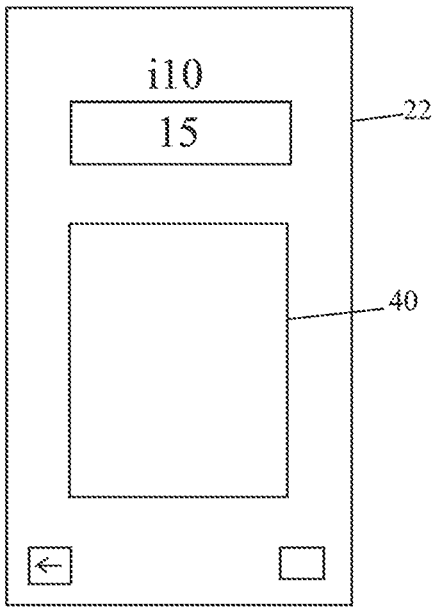
Figure 2I:
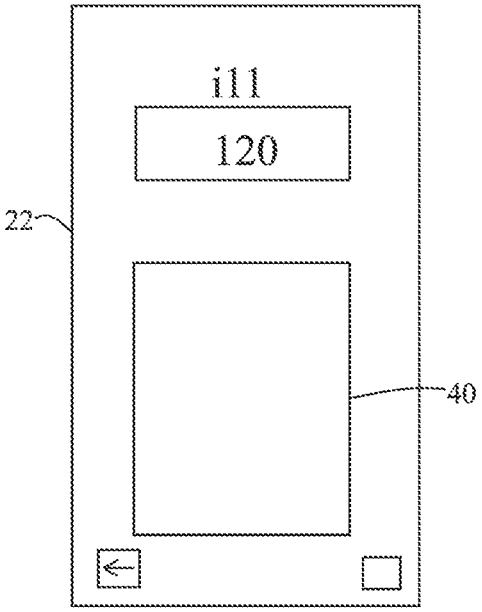

FIGS. 2A-2I show an exemplary embodiment of enabling adjustment of the parameter values through the user interface 22 of the oven. The contemplated interface 22 is a touch-screen interface that enables user selection of buttons displayed on the screen in order to move through a sequence that enables the adjustment of the parameter values for use going forward. Per FIG. 2A, the user selects a Toolbox button 30 on the screen, which leads to another screen (FIG. 2B) in which the user selects a Technical Parameters button 32. Here, per FIG. 2C, the adjustment sequence contemplates requiring user entry of a security code in order to enable the adjustment (e.g., a service person access code or a manager access code). However, in other implementations entry of a security code need not be required. Once the security code is verified, a further interface screen is generated per FIG. 2D, and the user selects a Parameters View button 34, resulting in the generation of the display in FIG. 2E, which shows various parameters P (e.g., i07 through i11) and corresponding values V for such parameters. Using a scroll bar 36, the user can highlight any one of the parameters and select that parameter for adjustment via the keyboard button 38. Once a parameter is selected, it can be adjusted via the keyboard 40. Here, in FIG. 2F, parameter i07 is selected and changed from 28 to 25. In FIG. 2G, parameter i08 is selected and changed from 111 to 80. In FIG. 2H, parameter i10 is selected and changed from 10 to 15. In FIG. 2I, parameter i11 is selected and changed from 180 to 120.

By way of example, parameter i07 may be used for adjusting the upper hysteresis point for the idle state, where each quantity 5=1° F. above the temperature setpoint (e.g., setting a value of 10 will set the upper hysteresis value to 2° F. above the setpoint). Parameter i08 may be used for adjusting the lower hysteresis point for the idle state (e.g., setting a value of 15 will set the lower hysteresis value to 3° F. below the setpoint). Parameter i10 may be used for adjusting the fan on time during the idle state, where the entered value is the seconds of on time. Parameter i11 may be used for adjusting the fan off time during the idle state, where the entered value is the seconds of off time (e.g., between on times).

Notably, the controller is, or can be, configured such that the cook state parameter are similarly adjustable.

In addition, adjustment of the parameters could be achieved remotely (e.g., via a wired or wireless connection to the controller 20, such as through a smart phone, tablet or other hand-held device).

In addition, the controller 20 may be configured to provide an interface screen button that enables the second set of parameter values to be enabled or disabled, such as an "ECO" button. If the second set of parameters are disabled, then the oven controller would not use the second set of parameter values during the idle state, and would instead use the first set of parameter values (i.e., same as the cook state).

It is to be clearly understood that the above description is intended by way of illustration and example only, is not intended to be taken by way of limitation, and that other changes and modifications are possible. For example, while rack ovens are primarily described herein, the technology can be implemented in other types of convection ovens. Other variations are possible.

What is claimed is:

1. A convection oven, comprising:

a cooking chamber for receiving food product to be cooked;

a door movable between an open condition and a closed condition relative to the cooking cavity;

a heating system for generating heat;

a fan system for moving heated air through the cooking cavity;

a controller configured for controlling the heating system and the fan system, wherein the controller includes an associated memory storing a first set of operating parameter values and a second set of operating parameter values;

wherein a cook state of the oven is an operating state in which food product is to be cooked in the cooking chamber and an idle state of the oven is an operating state in which food product is not being cooked but temperature in the cooking chamber is maintained so as to be ready to carry out a cook state;

wherein the controller is configured to identify whether the oven is in the cook state or the idle state;

wherein the controller is configured to use the first set of operating parameter values to control the heating system and the fan system during the cook state; and wherein the controller is configured to use the second set of operating parameter values to control the heating system and the fan system during the idle state;

wherein the first set of operating parameter values define at least a first hysteresis temperature range and the second set of operating parameter values define at least a second hysteresis temperature range, the second hysteresis temperature range being larger than the first hysteresis temperature range.

2. The oven of claim 1, wherein the controller includes a memory storing the first set of operating parameter values and the second set of operating parameter values.

3. The oven of claim 1, wherein the first set of operating parameter values include:

a first upper temperature hysteresis parameter value used to trigger turning off the heating system;

a first fan on time parameter value used to control an on duration of the fan system;

a first lower temperature hysteresis parameter value used to trigger turning on the heating system; and a first fan off time parameter value used to control an off duration of the fan system;

wherein the second set of operating parameter values include:

a second upper temperature hysteresis parameter value used to trigger turning off the heating system;

a second fan on time parameter value used to control an on duration of the fan system;

a second lower temperature hysteresis parameter value used to trigger turning on the heating system; and a second fan off time parameter value used to control an off duration of the fan system.

4. The oven of claim 2, wherein the controller includes an associated user interface, wherein the controller is configured to enable at least the second set of operating parameter values to be modified through use of the user interface.

5. A method of operating an oven that includes both a heating system and a fan system, the method comprising:

operating the oven in a cook state during which the heating system is controlled based at least in part upon a cook setpoint temperature, wherein during the cook state a first hysteresis temperature range encompassing the cook setpoint temperature is used to control an on or off state of the heating system; and operating the oven in an idle state during which the heating system is controlled based at least in part upon an idle setpoint temperature, wherein during the idle state a second hysteresis temperature range encompassing the idle setpoint temperature is used to control an on or off state of the heating system, wherein the second hysteresis temperature range is different than the first hysteresis temperature range;

wherein the second hysteresis temperature range is larger than the first hysteresis temperature range.

6. The method of claim 5, wherein the cook setpoint temperature is the same as the idle setpoint temperature.

7. The method of claim 5, wherein the cook state of the oven is defined at least in part by operation of a cook timer, and the idle state occurs when the cook timer is not operating.

8. The method of claim 7, wherein:

during the cook state the fan system is cycled between an on state and an off state;

during the idle state the fan system is cycled between the on state and the off state;

a duration of each cycle of the on state of the fan system during the cook state is greater than a duration of each cycle of the on state of the fan system during the idle state.

9. A method of operating an oven that includes both a heating system and a fan system, the method comprising:

operating the oven in a cook state during which the heating system is controlled based at least in part upon a cook setpoint temperature, wherein during the cook state a first hysteresis temperature range encompassing the cook setpoint temperature is used to control an on or off state of the heating system; and operating the oven in an idle state during which the heating system is controlled based at least in part upon an idle setpoint temperature, wherein during the idle state a second hysteresis temperature range encompassing the idle setpoint temperature is used to control an on or off state of the heating system, wherein the second hysteresis temperature range is different than the first hysteresis temperature range;

wherein the cook setpoint temperature is the same as the idle setpoint temperature.

10. The method of claim 9, wherein a lower hysteresis temperature of the second hysteresis temperature range is less than a lower hysteresis temperature of the first hysteresis temperature range.

* * * * *